United States Patent [19]

Janke

[11] 4,394,056

[45] Jul. 19, 1983

[54] DRAWER LOCKING MECHANISM

[75] Inventor: Elden W. Janke, Valencia, Calif.

[73] Assignee: Teradyne, Inc., Boston, Mass.

[21] Appl. No.: 233,557

[22] Filed: Feb. 11, 1981

[51] Int. Cl.[3] ..... E05B 65/46; E05C 15/04

[52] U.S. Cl. ..... 312/216; 312/218; 312/221; 312/222

[58] Field of Search ..... 312/215, 216, 217, 218, 312/219, 220, 221, 222, 333, 107.5; 292/120, 146, 162

[56] References Cited

U.S. PATENT DOCUMENTS

| | | | |
|---|---|---|---|
| 950;813 | 3/1910 | Bodenstein | 312/221 |
| 2,719,770 | 10/1955 | Roberts | 312/221 |
| 2,829,021 | 4/1958 | Wolters | 312/218 |
| 3,259,444 | 7/1966 | Friend | 312/221 |
| 3,323,849 | 6/1967 | Stark | 312/221 |
| 3,404,929 | 10/1968 | Wright et al. | 312/218 |
| 3,622,216 | 11/1971 | Haunost | 312/222 |
| 3,767,280 | 10/1973 | McLaughlin | 312/219 |
| 3,874,755 | 4/1975 | Hegg et al. | 312/221 |
| 3,883,200 | 5/1975 | Latham | 312/216 |

FOREIGN PATENT DOCUMENTS

| | | | |
|---|---|---|---|
| 2240643 | 4/1975 | France | 312/220 R |

*Primary Examiner*—Victor N. Sakran

[57] ABSTRACT

A mechanism preventing opening more than one drawer at one time, the mechanism having one movable locking bar for each drawer, using gravity to move a bar into interfering, locking position when its associated drawer is opened, and using an inclined surface to raise the bar into non-locking position as the drawer is shut.

7 Claims, 1 Drawing Figure

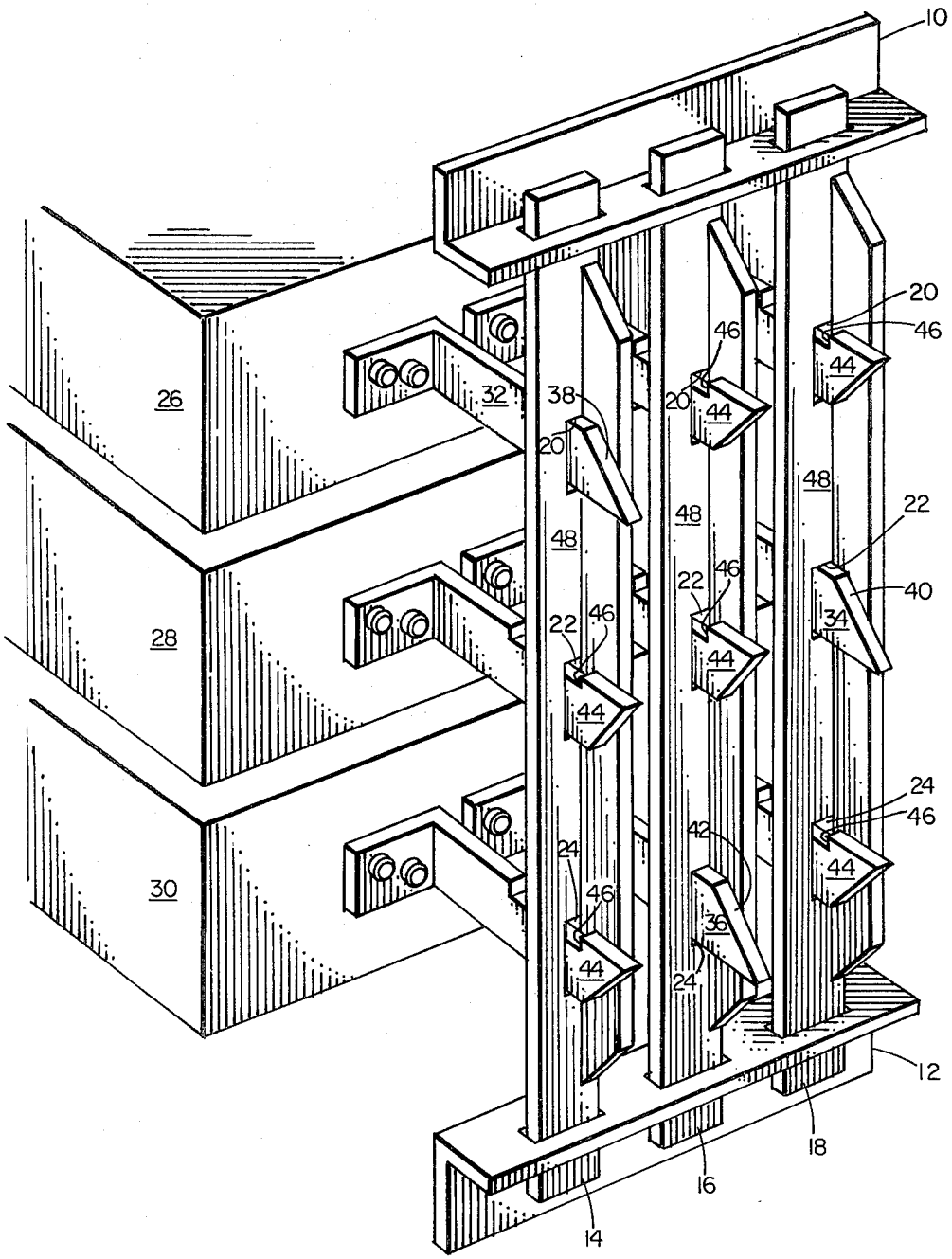
10
20
46
44
26
32
38
20
46
20
44
48
48
48
22
22
46
40
34
28
22
46
44
44
24
46
42
44
30
24
46
36
44
24
12
18
16
14

DRAWER LOCKING MECHANISM

FIELD OF THE INVENTION

The invention relates to mechanisms to prevent opening at one time more than one drawer of a vertical stack thereof.

BACKGROUND OF THE INVENTION

Cabinets often employ interlocking mechanisms allowing only one drawer to be opened at a time. For example, U.S. Pat. Nos. 3,874,755 and 2,719,770 disclose filing cabinet locking mechanisms employing a single locking bar. Opening of one drawer causes the bar to be vertically displaced into a locking position by action of a member against an inclined surface. When the drawer is closed, a second inclined surface causes the bar to be returned to its original position. In both of these patents, socket and lug or ball mechanisms are used to maintain the rods in a raised position against gravity.

SUMMARY OF THE INVENTION

It has been discovered that a simple, rugged interlocking device results from providing one locking bar for each drawer, using gravity to lower a bar into an interfering position, and using an inclined surface to raise the bar back to a noninterfering position as the drawer is shut. Such a device avoids reliance on, and the friction of, socket and lug or ball mechanisms used to keep locking bars raised.

In preferred embodiments, the inclined surfaces are on members attached to the drawers, and they pass through holes on the locking bars when the drawers are opened and shut; and interference is provided by notched members attached to the drawers and passing through holes in the locking bars.

Preferred Embodiment

The drawing, structure, and operation of a preferred embodiment will now be described.

DRAWING

The drawing is an isometric view of a mechanism according to the invention shown attached to drawers in a cabinet.

STRUCTURE

There is shown in the drawing a mechanism preventing the opening of more than one drawer of an electrical equipment cabinet at one time. Guides 10, 12 are mounted on the frame of the cabinet (not shown), and each have three rectangular holes through their horizontal portions in which angle-iron locking bars 14, 16, 18 are slidably mounted for limited vertical displacement. Each bar 14, 16, 18 has three rectangular holes 20, 22, 24 associated with drawers 26, 28, 30, respectively.

Each drawer 26, 28, 30 has a bar-raising member 32, 34, or 36 with upward facing inclined surfaces 38, 40, or 42, respectively, which surfaces pass through the holes in the associated locking bar as the drawers are closed and opened.

Each drawer 26, 28, 30 also has a pair of locking members 44 attached to it which pass through the holes in the locking bars not associated with the raising members 32, 34, 36. Each of these locking members 44 has a vertical surface 46, which is located slightly behind the plane passing through the rear surface 48 of its locking bar when its associated drawer is fully closed.

Operation

When all of the drawers are closed, all of the locking bars will be in raised positions, because the upper horizontal surfaces of raising members 32, 34, 36 will be acting against the upper horizontal contacting surfaces of holes 20, 22, 24 in the associated locking bars.

When a drawer is opened, for example, drawer 26, the inclined surface 38 passes through hole 20 in locking bar 14, thereby allowing locking bar 14 to lower by gravity so that portions of its rear surface 48 are moved into interfering positions with surface 46 of the locking members 44 associated with drawers 28, 30. Thus, when bar 14 is in this lower position, drawers 28, 30 cannot be opened.

As drawer 26 is closed, inclined surface 38 will contact the upper horizontal surface of hole 20 of locking bar 14, and cause locking bar 14 to be raised into a non-locking position.

Drawers 28, 30 and their associated raising members 34, 36 and guide bars 18, 16, respectively, function in the same manner.

Other embodiments within the claims will occur.

What is claimed is:

1. Locking mechanism for a plurality of vertically oriented horizontally reciprocal members which comprises a first member of said members, a second member of said members, a first vertically limitedly reciprocable locking bar, a second vertically limitedly reciprocable locking bar, first camming means carried by said first member for cooperation with said first vertically limitedly reciprocable locking bar to provide first vertical movement of said first vertically limitedly reciprocable locking bar when said first member is moved away from said first vertically reciprocable locking bar, second camming means carried by said second member for cooperation with said second vertically limitedly reciprocable locking bar to provide second vertical movement of said second vertically limitedly reciprocable locking bar when said second member is moved away from said second vertically reciprocable locking bar, first latch means carried by said first member for cooperation with said first vertically limitedly reciprocable locking bar to prevent horizontal movement of said second member upon said first vertical movement, and second latch means carried by said second member for cooperation with said second vertically limitedly reciprocable locking bar to prevent horizontal movement of said second member upon said second vertical movement.

2. The mechanism of claim 1 in which said first vertical movement and said second vertical movement are downward.

3. The locking mechanism of claim 1 in which said first camming means and said first latch means are integral, and in which said second camming means and said second latch means are integral.

4. The locking mechanism of claim 1 in which said camming means are ramps and said latch means are abutments.

5. The locking mechanism of claim 4 in which said camming means and said latch means cooperate with notches in said locking bars.

6. The locking mechanism of claim 4 which comprises a multiplicity of camming means, a corresponding multiplicity of latch means, and a corresponding multiplicity of locking bars.

7. Locking mechanism for a plurality of vertically oriented horizontally reciprocal members which comprises a first member of said members, a second member of said members, a first vertically limitedly reciprocable locking bar, a second vertically limitedly reciprocable locking bar, first camming means carried by one of said first member and said first locking bar for cooperation with said first vertically limitedly reciprocable locking bar to provide first vertical movement of said first vertically limitedly reciprocable locking bar when said first member is moved away from said first vertically reciprocable locking bar, second camming means carried by one of said second member and said second locking bar for cooperation with said second vertically limitedly reciprocable locking bar to provide second vertical movement of said second vertically limitedly reciprocable locking bar when said second member is moved away from said second vertically reciprocable locking bar, first latch means carried by one of said first member and said first locking bar for cooperation with said first vertically limitedly reciprocable locking bar to prevent horizontal movement of said second member upon said first vertical movement, and second latch means carried by one of said second member and said second locking bar for cooperation with said second vertically limitedly reciprocable locking bar to prevent horizontal movement of said second member upon said second vertical movement.

* * * * *